US006752194B1

(12) United States Patent
Huang

(10) Patent No.: US 6,752,194 B1
(45) Date of Patent: Jun. 22, 2004

(54) WINDOW BLIND HAVING AN OPERATING DEVICE FOR CONCEALED PULL ROPES THEREOF

(76) Inventor: Tai-Long Huang, No. 382, Yuan-Lu Rd., Sec. 1, Fuhsing, Changhua (TW)

( * ) Notice: Subject to any disclaimer, the term of this patent is extended or adjusted under 35 U.S.C. 154(b) by 0 days.

(21) Appl. No.: 10/408,350

(22) Filed: Apr. 8, 2003

(51) Int. Cl.[7] ..... E06B 9/30
(52) U.S. Cl. ..... 160/168.1 R; 160/176.1 R
(58) Field of Search ..... 160/168.1 R, 173 R, 160/172 R, 176.1 R, 177 R, 178.2 R

(56) References Cited

U.S. PATENT DOCUMENTS 4,869,308 A * 9/1989 Chang ..... 160/176.1 R
5,465,775 A * 11/1995 Biba et al. ..... 160/168.1 R
5,472,035 A * 12/1995 Biba et al. ..... 160/168.1 R
5,850,863 A * 12/1998 Huang ..... 160/168.1 R
5,904,198 A * 5/1999 Huang ..... 160/168.1 R

* cited by examiner

*Primary Examiner*—David Purol
(74) *Attorney, Agent, or Firm*—Baker Botts L.L.P.

(57) ABSTRACT

A window blind includes a housing, slats, and a bottom rail. A shaft is journalled in the housing. A pair of pull ropes extends through the housing and the slats, and connects the shaft to the bottom rail. A drive cord is coupled to the shaft. An operating device includes a pulling unit, a braking unit, and a positioning unit. The pulling unit permits extension of the drive cord therethrough, has the drive cord secured thereto, and is operable so as to rotate the shaft for raising the bottom rail. The braking unit provides a braking force that is transmitted to the shaft so as to retain the bottom rail at a desired vertical distance relative to the housing. The positioning unit permits extension of the drive cord therethrough and is operable so as to release the braking force for lowering the bottom rail.

6 Claims, 7 Drawing Sheets

WINDOW BLIND HAVING AN OPERATING DEVICE FOR CONCEALED PULL ROPES THEREOF

BACKGROUND OF THE INVENTION

1. Field of the Invention

The invention relates to a window blind, more particularly to a window blind having an operating device for concealed pull ropes thereof.

2. Description of the Related Art

Referring to FIGS. 1 and 2, a conventional window blind includes an elongated top housing 10, a horizontal shaft 11 journalled in the top housing 10, a plurality of slats 14 suspended one above another from the top housing 10, a bottom rail 16 disposed below the slats 14, a pair of pull ropes 141, a pair of ladder cords 13, and an operating rod 20. Each of the pull ropes 141 has an anchor end that passes through the top housing 10 and through the slats 14 and that is mounted to the bottom rail 16. Each of the ladder cords 13 is disposed on opposite longitudinal sides of the slats 14, and has an upper end that is secured to the shaft 11 and a lower end that is mounted on the bottom rail 16. The operating rod 20 is coupled to the horizontal shaft 16, permits extension of operating ends of the pull ropes 21 therethrough, includes a pair of retaining members 201, and is operable so as to actuate axial rotation of the horizontal shaft 11, thereby controlling tilting of the slats 14. The retaining members 201 are mounted on an outer surface of the operating rod 20 one above the other. The operating ends of the pull ropes 21, that extend out of the operating rod 20 when the slats 14 are raised, are wound around both of the retaining members 201 and are hooked on one of the retaining members 201. The conventional window blind achieves the purpose of preventing access to the operating ends of the pull ropes 21 by children, thereby avoiding danger in view of possible entanglement. However, the process of winding the operating ends of the pull ropes 21, that extend out of the operating rod 20 when the slats 14 are raised, causes inconvenience on the part of the user.

SUMMARY OF THE INVENTION

Therefore, the object of the present invention is to provide a window blind that has an operating device which can overcome the aforesaid drawback of the prior art.

According to the present invention, a window blind comprises an elongated top housing, first and second horizontal shafts, a plurality of horizontal slats, a bottom rail, a pair of pull ropes, a pair of ladder cords, and an operating device. Each of the first and second horizontal shafts is journalled within the top housing. The horizontal slats are suspended one above another from the top housing. The bottom rail is disposed below the slats. Each of the pull ropes extends through the top housing and the slats, and has an upper end connected to the first horizontal shaft and a lower end connected to the bottom rail. Each of the ladder cords is connected to the slats, and has an upper end connected to the second horizontal shaft and a lower end connected to the bottom rail. The operating device includes a hollow frame, a drive bobbin, a drive cord, a spiral spring, a clutch unit, a braking unit, a rotary tilt control unit, a positioning unit, and a pulling unit. The hollow frame is mounted on the top housing and has an innerwall surface. The drive bobbin is disposed rotatably in the frame and is coaxial with the first horizontal shaft. The drive cord has an upper end that is connected to the drive bobbin, and a lower end that extends out of the frame and through the top housing. The spiral spring is wound on the drive bobbin, and has opposite ends connected to the drive bobbin and the frame, respectively. The spiral spring provides a biasing force for biasing the drive bobbin to rotate in a first direction for winding the drive cord on the drive bobbin. The clutch unit includes a driven hub that is disposed rotatably in the frame and that is sleeved securely on the first horizontal shaft, and a coupling spring unit that is sleeved fittingly on the drive bobbin and the driven hub. The coupling spring unit is in friction engagement with the inner wall surface of the frame. The braking unit is disposed in the frame, and includes a braking member and a releasing cord. The braking member provides a braking force that acts on the driven hub when the driven hub tends to rotate in the first direction due to the weight of the bottom rail transmitted to the first horizontal shaft through the pull ropes. The releasing cord has an upper end that is connected to the braking member, and a lower end that extends out of the frame and through the top housing. The releasing cord is operable so as to enable the braking member to release the driven hub from the braking force. The rotary tilt control unit includes a tubular connector that is coupled to the second horizontal shaft. The tubular connector is axially rotatable relative to the frame such that axial rotation of the tubular connector results in corresponding axial rotation of the second horizontal shaft to adjust tilting angles of the slats. The tubular connector extends out of the top housing, and permits extension of the lower ends of the drive and releasing cords therethrough. The positioning unit is coupled to the tilt control unit. The positioning unit permits extension of the lower ends of the drive and releasing cords therethrough, and is connected to the lower end of the releasing cord. The pulling unit permits extension of the lower end of the drive cord thereinto. The pulling unit is connected to the lower end of the drive cord. Rotation of the drive bobbin in a second direction opposite to the first direction due to pulling action applied on the pulling unit enables the coupling spring unit to contract in radial inward directions in order to transmit rotation of the drive bobbin to the driven hub against biasing action of the spiral spring so that the driven hub rotates with the drive bobbin in the second direction, thereby resulting in corresponding rotation of the first horizontal shaft in the second direction for winding the pull ropes thereon and for raising the bottom rail toward the top housing. Rotation of the drive bobbin in the first direction due to restoring action of the spiral spring when the pulling unit is released from the pulling action enables the coupling spring unit to expand in radial outward directions so that the driven hub does not rotate with the drive bobbin. The braking force provided by the braking member is released upon operating the releasing cord so as to lower the bottom rail, and is sufficient so as to support the weight of the bottom rail and the weight of the slats that acts on the bottom rail in order to retain the bottom rail at a desired vertical distance relative to the top housing.

BRIEF DESCRIPTION OF THE DRAWINGS

Other features and advantages of the present invention will become apparent in the following detailed description of the preferred embodiment with reference to the accompanying drawings of which.

DETAILED DESCRIPTION OF THE PREFERRED EMBODIMENT

Figure 1:
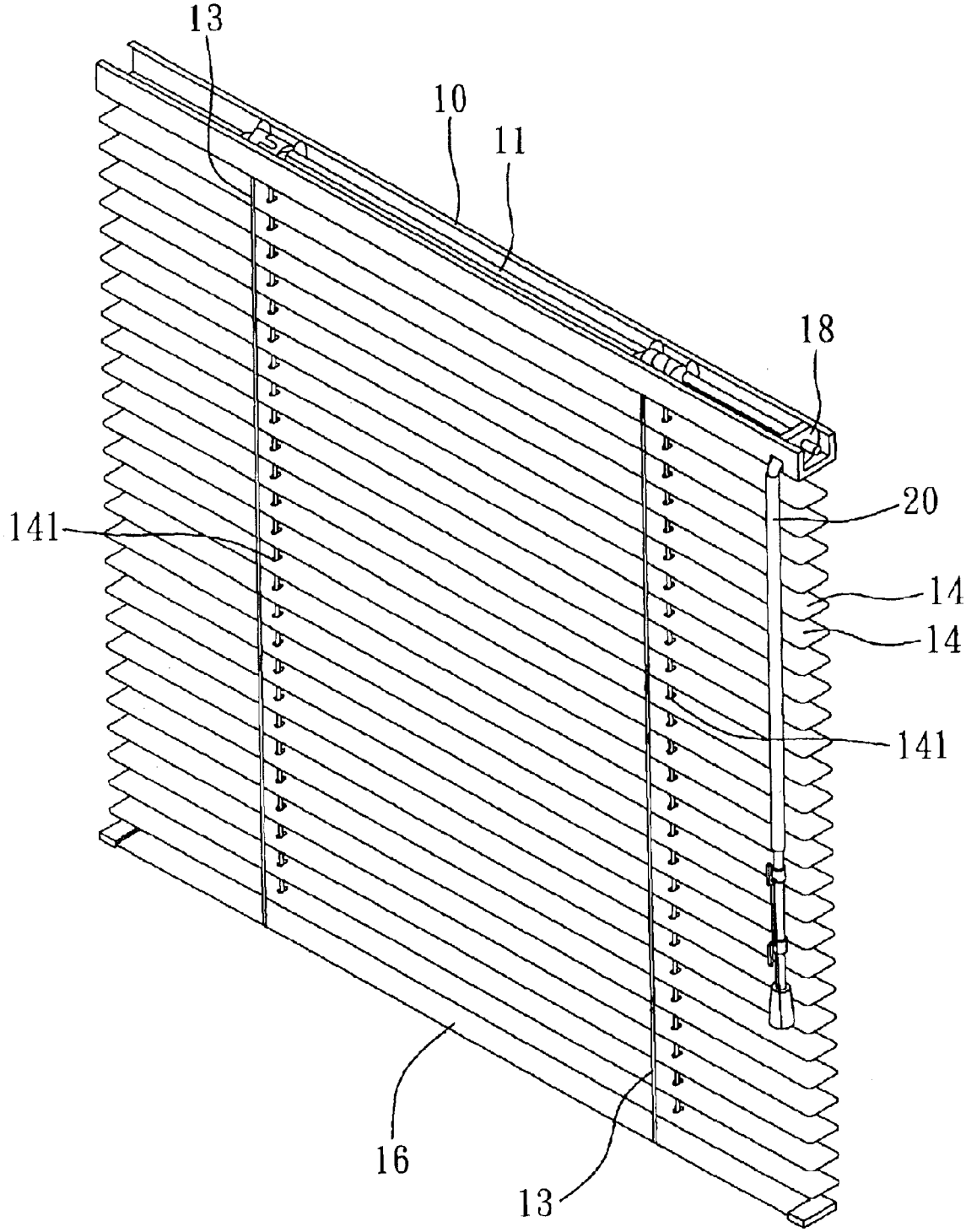
FIG. 1 PRIOR ART
FIG. 1 is a perspective view of a conventional window blind.
Figure 2:
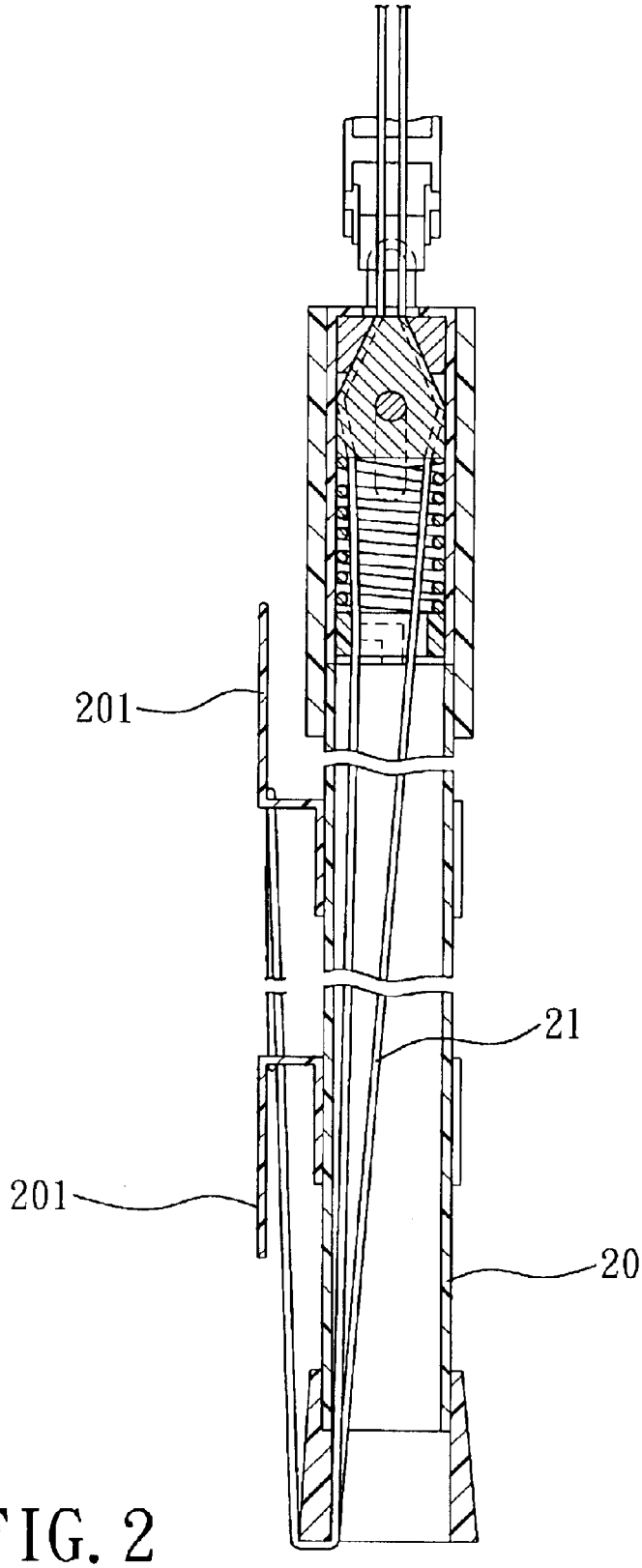
FIG. 2 PRIOR ART
FIG. 2 is a sectional view of an operating rod of the conventional window blind illustrating a pair of pull ropes wound around a pair of retaining members.
Figure 3:
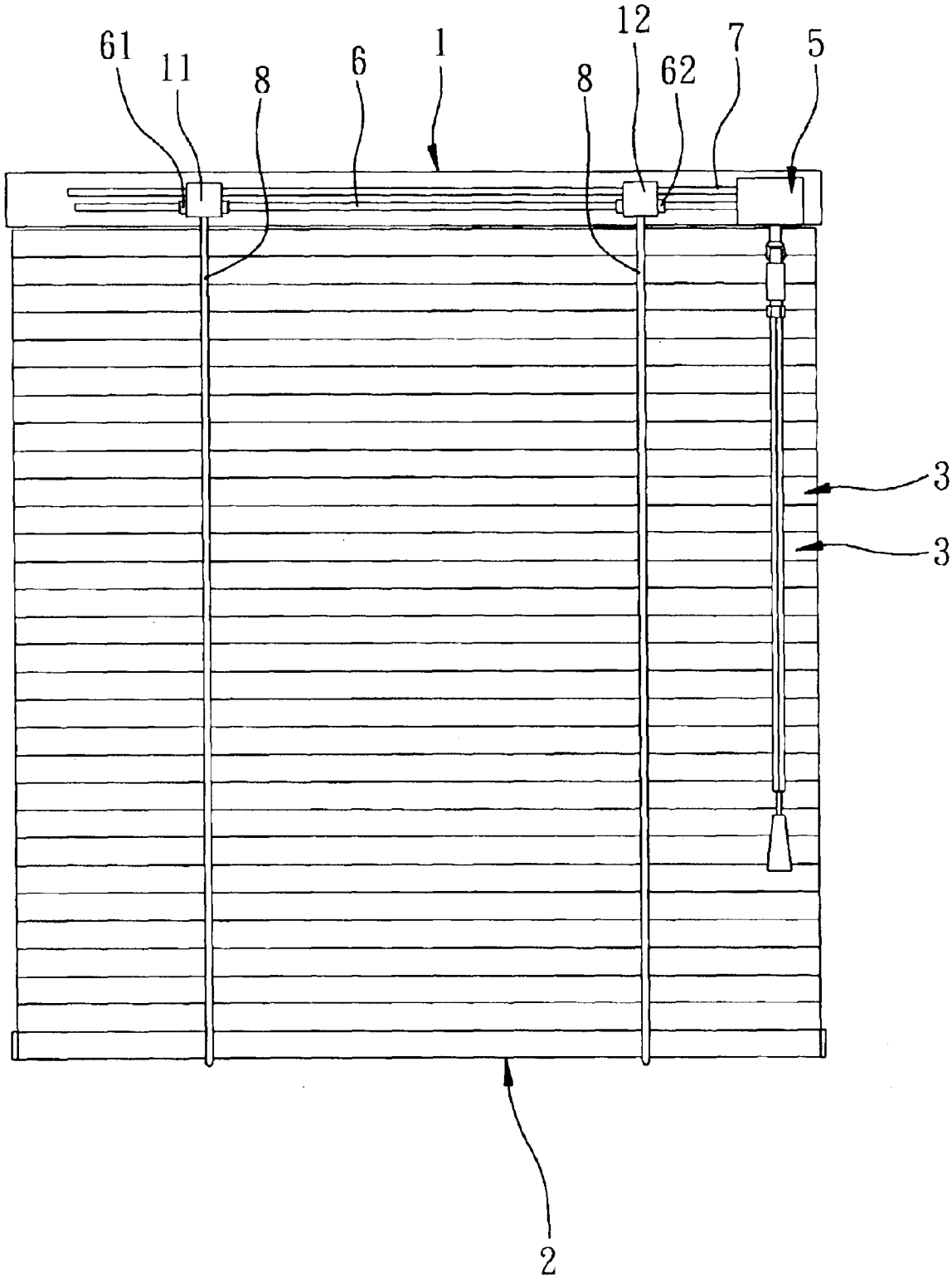
FIG. 3 is a schematic view of the preferred embodiment of a window blind according to the present invention.
Figure 4:
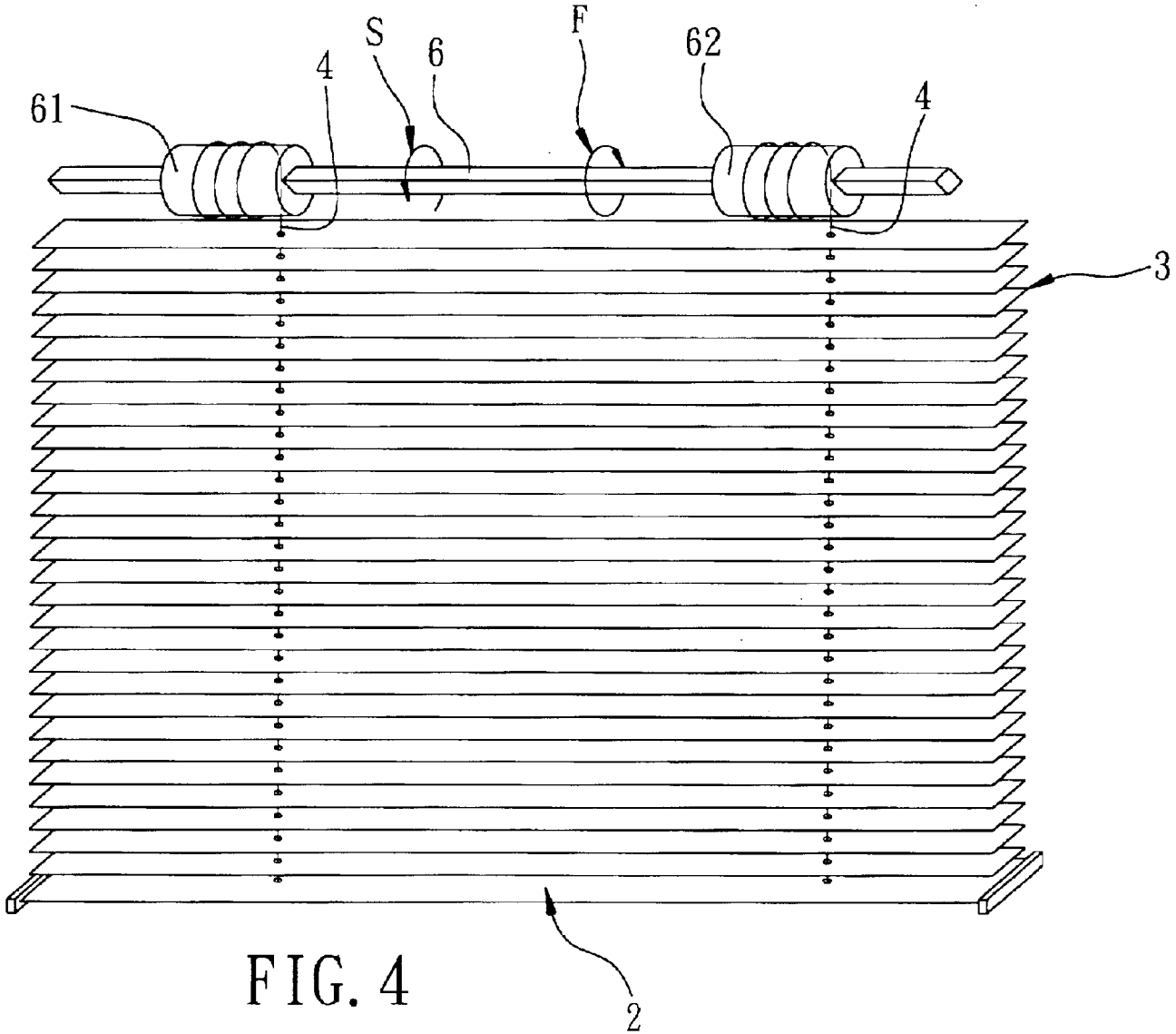
FIG. 4 is a perspective view to illustrate how a bottom rail can be raised and lowered.
Figure 5:
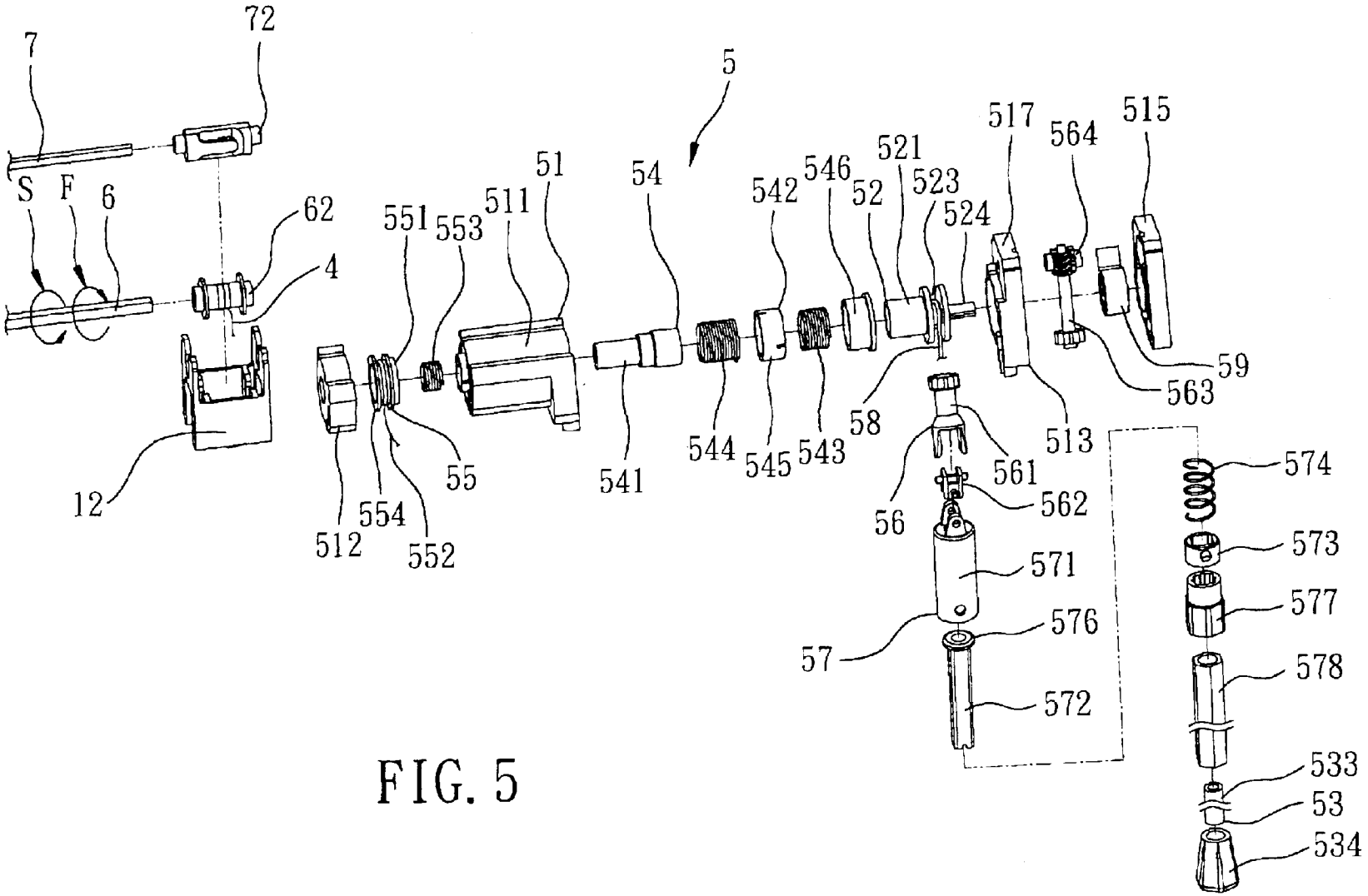
FIG. 5 is an exploded perspective view of an operating device of the preferred embodiment.

Referring to FIGS. 3, 4 and 5, the preferred embodiment of a window blind according to the present invention is shown to include an elongated top housing 1, first and second horizontal shafts 6, 7, a plurality of horizontal slats 3, a bottom rail 2, a pair of pull ropes 4, a pair of ladder cords 8, and an operating device 5.

The top housing 1 has left and right sides, and includes a pair of left and right journal boxes 11, 12 that are mounted on the left and right sides of the top housing 1, respectively. The first and second horizontal shafts 6, 7 are journalled on the left and right journal boxes 11, 12 in the top housing 1, and include a pair of first cord spools 61, 62 and a pair of second cord spools 72 (only one of the second cord spools 72 is visible in FIG. 5), respectively. Each of the first cord spools 61, 62 is disposed on a respective one of the left and right journal boxes 11, 12, and is mounted to rotate with the first horizontal shaft 6. Each of the second cord spools 72 is disposed on a respective one of the left and right journal boxes 11, 12 above a respective one of the first cord spools 61, 62, and is mounted to rotate with the second horizontal shaft 7. The horizontal slats 3 are suspended one above another from the top housing 1. The bottom rail 2 is disposed below the slats 3. Each of the pull ropes 4 extends through the top housing 1 and the slats 3, and has an upper end that is connected to the respective one of the first cord spools 61, 62 of the first horizontal shaft 6, and a lower end that is connected to the bottom rail 2. Each of the ladder cords 71, 72 is connected to the slats 3, and has an upper end that is connected to the respective one of the second cord spools 72 of the second horizontal shaft 7 and a lower end that is connected to the bottom rail 2. The construction as such permits rotation of the first horizontal shaft 6 in a first direction (F) which results in unwinding of the pull ropes 4 from the first cord spools 61, 62 so as to lower the bottom rail 2, and in a second direction (S) opposite to the first direction (F) which results in winding of the pull ropes 4 on the first cord spools 61, 62 so as to raise the bottom rail 2.

Figure 6:
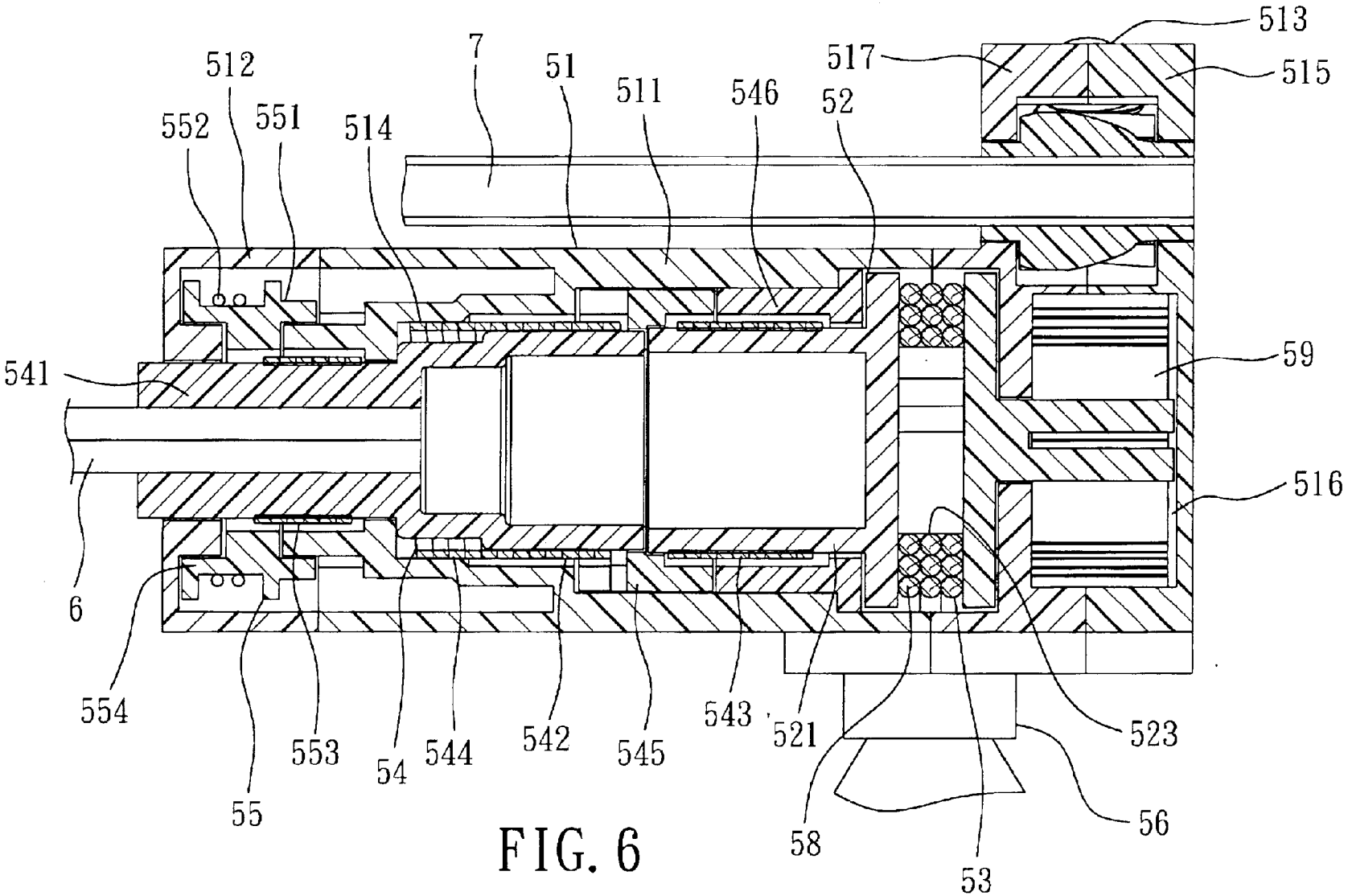
FIG. 6 is a fragmentary sectional view of a hollow frame, a drive bobbin, a drive cord, a spiral spring, a clutch unit, and a braking unit of the operating device in an assembled state.
Figure 7:
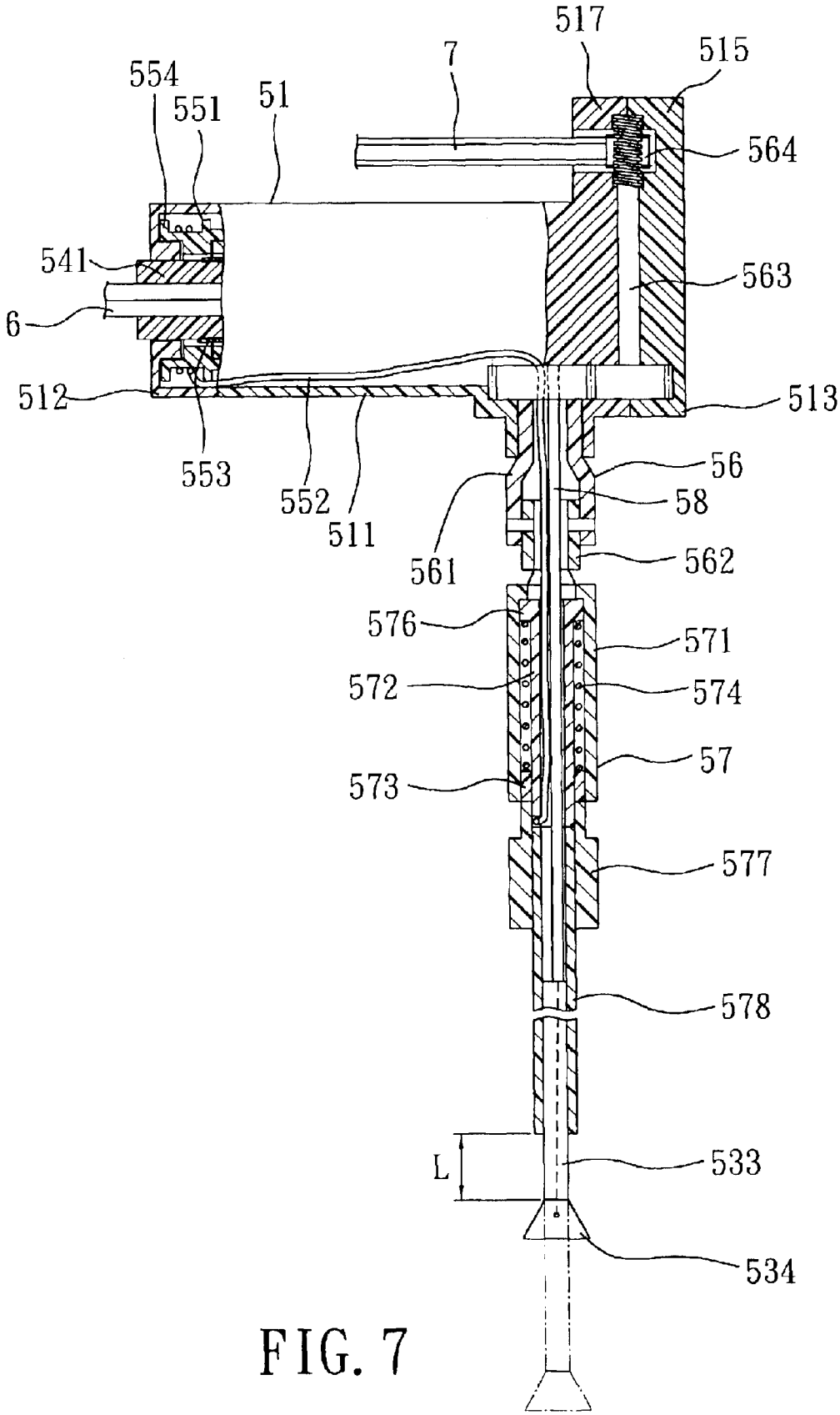
FIG. 7 is a fragmentary sectional view of a rotary tilt control unit, a positioning unit, and a pulling unit of the operating device in an assembled state.

With further reference to FIGS. 6 and 7, the operating device 5 includes a hollow frame 51, a drive bobbin 52, a drive cord 58, a spiral spring 59, a clutch unit 54, a braking unit 55, a rotary tilt control 56, a positioning unit 57, and a pulling unit 53.

The frame 51 is mounted on the top housing 1 adjacent to the right journal box 12, and includes a cylindrical casing 511, and two end covers 513, 512. The casing 511 is formed with an axial hole therethrough, and has an inner wall surface 514. The end covers 513, 512 are disposed on opposite ends of the casing 511, and are respectively distal and proximate to the right journal box 12. The end cover 513 includes a first part 515, and a second part 517 that cooperates with the first part 515 to confine an accommodating space 516. The first part 515 is formed with a slit (not visible).

The drive bobbin 52 is disposed rotatably in the frame 51, is coaxial with the first horizontal shaft 6, has a winding portion 523 that is formed with an annular groove, and is provided with first and second drive shafts 524, 521 that extend in opposite directions from the winding portion 523. The first drive shaft 524 has a diameter smaller than that of the second drive shaft 521, is formed with a slit, and extends rotatably into the accommodating space 516 of the end cover 513 through an axial hole in the second part 517 of the end cover 513. The second drive shaft 521 and the winding portion 523 are disposed rotatably in the axial hole of the casing 511 of the frame 51.

The drive cord 58 has an upper end that is connected to the winding portion 523 of the drive bobbin 52 in the annular groove, and a lower end that extends out of the casing 511 of the frame 51 and through the top housing 1.

The spiral spring 59 is disposed in the accommodating space 516, is wound on the first drive shaft 524 of the drive bobbin 52, and has opposite inner and outer ends that are connected to the respective slits in the first drive shaft 524 of the drive bobbin 52 and the first part 515 of the end cover 513 of the frame 51. The spiral spring 59 provides a biasing action for biasing the drive bobbin 52 to rotate in the first direction (F) for winding the drive cord 58 on the winding portion 523 of the drive bobbin 52.

The clutch unit 54 includes a driven hub 541 and a coupling spring unit 542. The driven hub 541 is disposed rotatably in the frame 51, is sleeved securely on the first horizontal shaft 6, and has opposite first and second end portions. The second end portion has a diameter smaller than that of the first end portion, and extends out of the axial hole in the casing 511 and through an axial hole in the end cover 512. The coupling spring unit 542 includes a first spring 543 that is sleeved fittingly on the second drive shaft 521 of the drive bobbin 52, that is wound in the second direction (S) and that has a connecting end. An abutting member 546 is sleeved rotatably on the first spring 543, has a first end that abuts against the winding portion 523 of the drive bobbin 52, and a second end opposite to the first end of the abutting member 546. A connecting member 545 has a first end that is connected to the connecting end of the first spring 543 and that abuts against the second end of the abutting member 546, and a second end opposite to the first end of the connecting member 545. A second spring 544 is wound in a same winding direction as the first spring 543, has a connecting end connected to the second end of the connecting member 545, is sleeved fittingly on the first end portion of the driven hub 541, and is in friction engagement with the inner wall surface 514 of the casing 511 of the frame 51. In this embodiment, the abutting member 546 keeps the connecting member 545 from moving axially toward the winding portion 523 of the drive bobbin 52. In a modified embodiment, the first and second springs 543, 544 can be formed integrally, thereby dispensing with the abutting and connecting members 546, 545.

The braking unit 55 is disposed in the frame 51, and includes a braking member 551 and a releasing cord 552. The braking member 551 includes a releasing wheel 554 and a brake spring 553. The releasing wheel 554 is disposed in the end cover 512 of the frame 51, is sleeved rotatably on the first horizontal shaft 6, and is formed with an annular groove. The brake spring 553 is wound in a same direction as the springs 543, 544 direction, is sleeved fittingly on the second end portion of the driven hub 541, has opposite ends connected to the casing 511 of the frame 51 and the releasing wheel 554, respectively, and provides a braking force that acts on the second end portion of the driven hub 541 when the driven hub 541 tends to rotate in the first direction (F) due to the weight of the bottom rail 2 transmitted to the first horizontal shaft 6 through the pull ropes 4 and a biasing force for biasing the releasing wheel 554 to rotate in the first direction (F) for winding the releasing cord 552 on the releasing wheel 554. The releasing cord 552 has an upper end that is connected to the releasing wheel 554 of the braking member 551, and a lower end that extends out of the frame 51 and through the top housing 1, and is operable so as to enable the brake spring 553 of the braking member 551 to release the second end portion of the driven hub 541 from the braking force. In this embodiment, the braking force provided by the brake spring 553 of the braking member 551 is released upon operating the releasing cord 552 so as to lower the bottom rail 2, and is sufficient so as to support the weight of the bottom rail 2 and the weight of the slats 3 that acts on the bottom rail 2 in order to retain the bottom rail 2 at a desired vertical distance relative to the top housing 1.

The rotary tilt control unit 56 includes a tubular connector that is coupled to the second horizontal shaft 7, and that includes first and second shafts 563, 561. The first shaft 563 is disposed in the accommodating space 516 of the end cover 513 of the frame 51, and has top and bottom ends that are formed with a worm 564 and gear teeth, respectively. The worm 564 meshes with a worm gear on the second horizontal shaft 7. The second shaft 561 is tubular, extends out of the end cover 513 of the frame 51 and through the top housing 1, permits extension of the lower ends of the drive and releasing cords 58, 552 therethrough, and has an inner end that is disposed in the accommodating space 516, and an outer end that is disposed externally of the accommodating space 516. The inner end is formed with gear teeth that mesh with the gear teeth of the first shaft 563. In this embodiment, the tubular connector is axially rotatable relative to the frame 51 such that axial rotation of the tubular connector results in corresponding axial rotation of the second horizontal shaft 7 to adjust tilting angles of the slats 3.

The positioning unit 57 includes a positioning tube 571, a retaining member, a positioning member 573, and a biasing spring 574. The positioning tube 571 has a top wall that is formed with a top opening, and a surrounding wall that extends downwardly from a periphery of the top wall. The top wall and the surrounding wall cooperatively confine a receiving space. The top opening in the topwall of the positioning tube 571 of the positioning unit 57 permits extension of the lower-ends of the drive and releasing cords 58, 552 into the receiving space. The surrounding wall has a bottom end that is opposite to the top wall.

The tilt control unit 56 further includes a universal joint 562 that couples pivotally the outer end of the second shaft 561 of the tubular connector to the top wall of the positioning tube 571. As such, axial rotation of the positioning tube 571 will result in corresponding axial rotation of the tubular connector. The universal joint 562 is further formed with a central opening that permits passage of the lower ends of the drive and releasing cords 58, 552 therethrough.

The retaining member includes a hollow rod 572 that is axially and movably disposed in the receiving space of the positioning tube 571. The rod 572 has a rectangular cross-section along a horizontal plane, permits extension of the lower ends of said drive and releasing cords 58, 552 therethrough, and has a top end that is formed with an annular flange 576 and a bottom end that is connected to the lower end of the releasing cord 552.

The positioning member 573 is annular in shape, is disposed at the bottom end of the surrounding wall of the positioning tube 571, and is formed with a central opening that permits passage of the bottom end of the hollow rod 572 and the lower ends of the drive and releasing cords 58, 552 therethrough.

The biasing spring 574 is sleeved on the rod 572 of the retaining member and is disposed in the receiving space of the positioning tube 571. The biasing spring 573 has opposite ends abutting respectively against the annular flange 576 and the positioning member 573 and biases the retaining member toward the top wall of the positioning tube 571.

The retaining member further includes an elongated sleeve 578 that is coupled to the rod 572, that permits extension of the lower end of the drive cord 58 therethrough, and that has a hexagonal cross-section along the horizontal plane. A coupler 577 couples the retaining member to the sleeve 578, and has top and bottom ends. The top end of the coupler 577 is formed with a recess that complements the rectangular cross-section of the rod 572 so as to sleeve fittingly on the bottom end of the rod 572. The bottom end of the coupler 577 is formed with a recess that complements the hexagonal cross-section of the sleeve 578 so as to sleeve fittingly on a top end of the sleeve 578.

The pulling unit 53 includes an elongated tube 533 that is axially movable in the sleeve 578. The tube 533 has an inner section that is disposed in the sleeve 578 and an outer section that extends out of a bottom end of the sleeve 578. The tube 533 permits extension of the lower end of the drive cord 58 thereinto and has the lower end of the drive cord 58 secured thereto. A cap member 534 has a top end that is formed with a recess and is sleeved fittingly on the bottom end of the tube 533.

To raise the bottom rail 2, the pulling unit 53 is pulled downwardly from an initial position. This results in rotation of the drive bobbin 52 in the second direction (S) due to unwinding of a length of the drive cord 58 thereon, and in deformation of the spiral spring 59 from an initial state. This then enables the first spring 543 of the coupling spring unit 542 to contract in radial inward directions, to rotate with the drive bobbin 52 in the second direction (S), and to cause the connecting member 545 to rotate in the second direction (S). This subsequently enables the second spring 544 of the coupling spring unit 542 to contract in radial inward directions, and to rotate with the connecting member 545 in the second direction (S) in order to transmit rotation of the drive bobbin 52 to the driven hub 541 against biasing action of the spiral spring 59 so that the driven hub 541 rotates with the drive bobbin 52 in the second direction (S). This in turn enables the brake spring 553 to expand in radial outward directions so that the driven hub 541 is released from the braking force provided by the brake spring 553, there by resulting in corresponding rotation of the first horizontal shaft 6 in the second direction (S) for winding the pull ropes 4 on the first cord spools 61, 62, and for raising the 10 slats 3 and the bottom rail 2 toward the top housing 1. In this embodiment, by selecting an appropriate length of the drive cord 58 that is wound on the drive bobbin 52, the bottom rail 2 can be raised by a predetermined height each time the pulling unit 534 is subjected to the downward pulling action, and the inner section of the tube 533 can be prevented from fully extending out of the sleeve 578 even when the cap member 534 is pulled to a lower limit position. As such, the lower end of the drive cord 58 is never exposed.

Due to the restoring action of the spiral spring 59, when the pulling unit 53 is released from the pulling action, the drive bobbin 52 rotates in the first direction (F), which results in winding of the drive cord 58 on the winding portion 523 of the drive bobbin 52, and in axial upward movement of the pulling unit 53 to its initial position. Rotation of the drive bobbin 52 in the first direction (F) enables the first spring 543 of the coupling spring unit 543 to expand in radial outward directions so that the driven hub 541 does not rotate with the driven bobbin 52 in the second direction (S). At this time, the first horizontal shaft 6 tends to rotate in the first direction (F) due to the weight of the bottom rail 2 and the weight of the slats 3 that acts on the bottom rail 2. This in turn enables the brake spring 533 to contract in radial inward directions such that the brake spring 533 provides the braking force that acts on the second end portion of the driven hub 541 and that arrests unintended rotation of the first horizontal shaft 6.

From the above description, when a pulling action is applied on the pulling unit 53, the bottom rail 2 is raised by the predetermined height, and when the pulling action on the pulling unit 53 is released, the pulling unit 53 moves back automatically to its initial position. As such, repeatedly applying and releasing the pulling action on the pulling unit 53 can raise the bottom rail 2 in increments to an upper limit position.

To lower the bottom rail 2, the sleeve 578 of the retaining member is pulled downwardly from an original position. This results in rotation of the releasing wheel 554 in the second direction (S) against biasing action of the brake spring 553 due to unwinding of the releasing cord 552 from the releasing wheel 554, and in compression of the biasing spring 574. At this time, the brake spring 553 expands in radial outward directions so that the driven hub 541 is released from the braking force provided by the brake spring 553. This therefore results in corresponding rotation of the first horizontal shaft 6 in the first direction (F) for unwinding the pull ropes 4 from the first cord spools 61, 62, and for lowering the slats 3 and the bottom rail 2. Preferably, the outer section of the tube 533 that extends out of the sleeve 578 has a length (L) that is sufficient to ensure that the bottom end of the sleeve 578 does not come in to contact with the cap member 534 even when the sleeve 578 is pulled to a lower limit position. As such, the pulling unit 53 can be prevented from being pulled together with the sleeve 578.

Due to the restoring action of the brake spring 553, when the retaining member is released from the pulling action applied on the sleeve 578, the releasing wheel 554 rotates in the first direction (F) to wind the releasing cord 553 on the releasing wheel 554. At the same time, the biasing spring 574 expands to result in axial upward movement of the retaining member toward its original position. Rotation of the releasing wheel 554 in the first direction (F) in turn enables the brake spring 553 to contract in radial inward directions such that the brake spring 553 provides the braking force that acts on the second end portion of the driven hub 541 and that impedes rotation of the first horizontal shaft 6 in the first direction (F).

To adjust tilting angles of the slats 3, a twisting action is applied on the positioning tube 571 of the positioning unit 57. Since the positioning tube 571 is connected to the tubular connector through the universal joint 562, the tubular connector can be rotated axially, thereby resulting in corresponding axial rotation of the second horizontal shaft 7 in the a fore mentioned manner so as to adjust tilting of the slats 3.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A window blind comprising:

an elongated top housing;

first and second horizontal shafts journalled within said top housing;

a plurality of horizontal slats suspended one above another from said top housing;

a bottom rail disposed below said slats;

a pair of pull ropes extending through said top housing and said slats, each of said pull ropes having an upper end connected to said first horizontal shaft and a lower end connected to said bottom rail;

a pair of ladder cords connected to said slats, each of said ladder cords having an upper end connected to said second horizontal shaft and a lower end connected to said bottom rail; and an operating device including a hollow frame mounted on said top housing and having an inner wall surface, a drive bobbin disposed rotatably in said frame and coaxial with said first horizontal shaft, a drive cord having an upper end that is connected to said drive bobbin, and a lower end that extends out of said frame and through said top housing, a spiral spring wound on said drive bobbin, and having opposite ends connected to said drive bobbin and said frame, respectively, said spiral spring providing a biasing force for biasing said drive bobbin to rotate in a first direction for winding said drive cord on said drive bobbin, a clutch unit including a driven hub disposed rotatably in said frame and sleeved securely on said first horizontal shaft, and a coupling spring unit sleeved fittingly on said drive bobbin and said driven hub, said coupling spring unit being in friction engagement with said inner wall surface of said frame, a braking unit disposed in said frame, and including a braking member and a releasing cord, said braking member providing a braking force that acts on said driven hub when said driven hub tends to rotate in the first direction due to the weight of said bottom rail transmitted to said first horizontal shaft through said pull ropes, said releasing cord having an upper end that is connected to said braking member, and a lower end that extends out of said frame and through said top housing, said releasing cord being operable so as to enable said braking member to release said driven hub from the braking force, a rotary tilt control unit including a tubular connector coupled to said second horizontal shaft, said tubular connector being axially rotatable relative to said frame such that axial rotation of said tubular connector results in corresponding axial rotation of said second horizontal shaft to adjust tilting angles of said slats, said tubular connector extending out of said top housing, and permitting extension of said lower ends of said drive and releasing cords therethrough, a positioning unit coupled to said tilt control unit, said positioning unit permitting extension of said lower ends of said drive and releasing cords therethrough, and being connected to said lower end of said releasing cord, and a pulling unit permitting extension of said lower end of said drive cord thereinto, said pulling unit being connected to said lower end of said drive cord;

wherein rotation of said drive bobbin in a second direction opposite to the first direction due to pulling action applied on said pulling unit enables said coupling spring unit to contract in radial inward directions in order to transmit rotation of said drive bobbin to said driven hub against biasing action of said spiral spring so that said driven hub rotates with said drive bobbin in the second direction, thereby resulting in corresponding rotation of said first horizontal shaft in the second direction for winding said pull ropes thereon and for raising said bottom rail toward said top housing;

wherein rotation of said drive bobbin in the first direction due to restoring action of said spiral spring when said pulling unit is released from the pulling action enables said coupling spring unit to expand in radial outward directions so that said driven hub does not rotate with said drive bobbin; and wherein the braking force provided by said braking member is released upon operating said releasing cord so as to lower said bottom rail, and is sufficient so as to support the weight of said bottom rail and the weight of said slats that acts on said bottom rail in order to retain said bottom rail at a desired vertical distance relative to said top housing.

2. The window blind as claimed in claim 1, wherein said positioning unit includes a positioning tube coupled to said tilt control unit and having a top wall and a surrounding wall that extends downwardly from a periphery of said top wall, said top wall and said surrounding wall cooperatively confining a receiving space, said surrounding wall having a bottom end opposite to said top wall, a retaining member axially and movably disposed in said receiving space, said retaining member including a hollow rod, said hollow rod having a top end that is formed with an annular flange and a bottom end that is connected to said lower end of said releasing cord, a positioning member disposed at said bottom end of said surrounding wall and formed with a central opening that permits passage of said bottom end of said hollow rod and said lower end of said drive cord therethrough, and a biasing spring sleeved on said retaining member and disposed in said positioning tube, said biasing spring having opposite ends abutting respectively against said annular flange and said positioning member and biasing said retaining member toward said top wall of said positioning tube.

3. The window blind as claimed in claim 2, wherein said tilt control unit further includes a universal joint that couples pivotally said tubular connector to said top wall of said positioning tube.

4. The window blind as claimed in claim 2, wherein said retaining member further includes an elongated sleeve that is coupled to said rod and that permits extension of said lower end of said drive cord therethrough, said pulling unit including an elongated tube that is axially movable in said elongated sleeve, said elongated tube permitting extension of said lower end of said drive cord therethrough and having said lower end of said drive cord secured thereto.

5. The window blind as claimed in claim 1, wherein said coupling spring unit includes a first spring sleeved fittingly on said drive bobbin and having a connecting end, a connecting member connected to said connecting end of said first spring, and a second spring having a connecting end connected to said connecting member, said second spring being sleeved fittingly on said driven hub and being in friction engagement with said inner wall surface of said frame.

6. The window blind as claimed in claim 1, wherein said braking member includes a releasing wheel that is disposed in said frame and that is sleeved rotatably on said first horizontal shaft, and a brake spring that is sleeved fittingly on said driven hub, and that has opposite ends connected to said frame and said releasing wheel, respectively;

wherein tendency of said first horizontal shaft to rotate in the first direction due to the weight of said bottom rail enables said brake spring to contract in radial inward directions such that said brake spring provides the braking force that acts on said driven hub and that arrests unintended rotation of said first horizontal shaft;

wherein rotation of said driven hub in the second direction due to the pulling action on said pulling unit enables said brake spring to expand in radial outward directions so that said driven hub is released from the braking force provided by said brake spring;

wherein rotation of said releasing wheel in the second direction due to the pulling action applied on said positioning unit enables said brake spring to expand in the radial outward directions; and wherein releasing of said positioning unit from the pulling action enables said brake spring to provide a biasing force for biasing said releasing wheel to rotate in the first direction for winding said releasing cord on said releasing wheel.

* * * * *